US009668938B2

(12) United States Patent
Imai

(10) Patent No.: US 9,668,938 B2
(45) Date of Patent: Jun. 6, 2017

(54) MEDICAL CONTAINER

(71) Applicant: TERUMO KABUSHIKI KAISHA, Shibuya-ku (JP)

(72) Inventor: Masaomi Imai, Ashigarakami-gun (JP)

(73) Assignee: TERUMO KABUSHIKI KAISHA, Shibuya-Ku, Tokyo (JP)

( * ) Notice: Subject to any disclaimer, the term of this patent is extended or adjusted under 35 U.S.C. 154(b) by 526 days.

(21) Appl. No.: 14/221,800

(22) Filed: Mar. 21, 2014

(65) Prior Publication Data

US 2014/0202906 A1 Jul. 24, 2014

Related U.S. Application Data

(63) Continuation of application No. PCT/JP2012/071310, filed on Aug. 23, 2012.

(30) Foreign Application Priority Data

Sep. 27, 2011 (JP) ..... 2011-211611

(51) Int. Cl.
*A61J 1/20* (2006.01)
*A61J 1/14* (2006.01)
*B65B 69/00* (2006.01)

(52) U.S. Cl.
CPC ..... *A61J 1/20* (2013.01); *A61J 1/1406* (2013.01); *A61J 1/2096* (2013.01); *B65B 69/00* (2013.01); *A61J 1/1418* (2015.05); *A61J 1/201* (2015.05)

(58) Field of Classification Search
CPC A61J 1/20; A61J 1/1406; A61J 1/2096; A61J 1/201; A61M 5/32
(Continued)

(56) References Cited

U.S. PATENT DOCUMENTS 6,258,078 B1 * 7/2001 Thilly ..... A61J 1/2096 206/363
9,480,621 B2 * 11/2016 Imai ..... A61J 1/2096
2008/0249498 A1 * 10/2008 Fangrow ..... A61J 1/2096 604/411

FOREIGN PATENT DOCUMENTS

JP 2010-179063 A 8/2010
WO WO 2010/004926 A1 1/2010
(Continued)

OTHER PUBLICATIONS

International Search Report (PCT/ISA/210) mailed on Sep. 25, 2012, by the Japanese Patent Office as the International Searching Authority for International Application No. PCT/JP2012/071310.

*Primary Examiner* — Anthony Stashick
*Assistant Examiner* — Raven Collins
(74) *Attorney, Agent, or Firm* — Buchanan Ingersoll & Rooney PC

(57) ABSTRACT

The medical container includes a container body having a proximal end opening, a proximal-end edge portion surrounding the proximal end opening, a plug body sealing a mouth section; a bag body including an edge portion fixed in a fluid-tight manner to the proximal-end edge portion, and a flexible reversing part surrounded by the edge portion. In a first state, the reversing part expands toward a distal end side and in a second state the reversing part expands toward a proximal end side. The medical container further includes a protection cover which can take a proximal end side mounting state in which the protection cover is mounted on the container body so as to cover the proximal end opening, and a distal end side mounting state in which the protection cover is mounted on the container body so as to cover the proximal end opening, and a distal end side mounting state in which the protection cover is mounted on the container body so as to cover the mouth section.

20 Claims, 11 Drawing Sheets

(58) Field of Classification Search
USPC ..... 206/438, 364; 53/492
See application file for complete search history.

(56) References Cited

FOREIGN PATENT DOCUMENTS

| | | | |
|---|---|---|---|
| WO | WO 2010/122872 | A1 | 10/2010 |
| WO | WO 2011/093389 | A1 | 8/2011 |

* cited by examiner

MEDICAL CONTAINER

CROSS REFERENCES TO RELATED APPLICATION

This application is a continuation of International Application No. PCT/JP2012/071310 filed on Au. 23, 2012, which claims priority to Japanese Application No. 2011-211611 filed on Sep. 27, 2011, the entire content of both of which is incorporated herein by reference.

TECHNICAL FIELD

The present disclosure relates to a medical container.

BACKGROUND DISCUSSION

Normally, many medicines are stored in vial containers (medicine-storing containers) each having a mouth section sealed with a rubber plug. The medicines include, for example, liquid preparation and powdery preparation that has to be dissolved. A method of operating a vial container in the former case (hereafter referred to as "Case 1") and a method of operating a vial container in the latter case (hereafter referred to as "Case 2") will be described below.

Case 1

A cap that covers a mouth section of the vial container is detached.

A rubber plug of the vial container is disinfected with cotton containing alcohol.

Air slightly less than a liquid amount to be collected is injected into a syringe.

A needle mounted on the syringe is inserted orthogonally through the rubber plug.

The vial container is turned upside down together with the syringe, and a position of the vital container is adjusted such that a needlepoint is located lower than a liquid surface. Then, an appropriate amount of the liquid medicine is sucked into the syringe. In this instance, a pressure inside the vial container becomes negative.

The position of the vital container is adjusted such that the needlepoint is located higher than the liquid surface, and the air is returned into the vial container at the mercy of a pressure difference by the amount that has been sucked.

The previous two steps are repeated, and a prescribed amount of the medicine is collected.

After completion of collecting the medicine, an appropriate amount of the air is sucked from the vial container, and the needle is taken out, keeping the pressure inside the vial container negative.

Case 2

A syringe filled with dissolving liquid to dissolve a medicine is prepared.

A cap that covers a mouth section of the vial container containing the medicine is detached.

A rubber plug of the vial container is disinfected with cotton containing alcohol.

needle mounted on the syringe is inserted orthogonally through the rubber plug.

Air is released from the vial container by the amount of the dissolving liquid to be injected so as to make the pressure inside the vial container negative.

The dissolving liquid is slowly injected at the mercy of a pressure difference without foaming.

After injection of the dissolving liquid, the vial container is slowly shaken with the syringe fixed together so as to dissolve the medicine. In the case where the medicine is hardly dissolved, the needle is to be taken out once, and then the container is shaken. In this instance, preferably the needle is taken out, keeping the pressure inside the vial container negative.

After confirming that the medicine is completely dissolved, a necessary amount of the medicine is collected in the same method as Case 1.

In the case where a full amount of the medicine specified in the Drug Standards is not to be used, a necessary amount of the liquid medicinal is measured by graduations of the syringe. However, in this case, the pressure inside the vial container may temporarily become positive. Therefore, when the needle is to be taken out, an appropriate amount of air is to be sucked before taking out the needle so as to keep the pressure inside the vial container negative, paying careful attention not to leak any medicinal liquid from a needle hole.

In both Cases 1 and 2, the pressure control is required, which is laborious.

Also, in the case of a medicine that is dangerous if exposed, such as carcinostatic agents, attention has to be paid especially at the time of controlling the pressure. In the case where this pressure control is not carried out correctly, there is a possibility, for example, that the medicine is spattered from the vial container at the time of taking out the needle. The medicine may be spattered because the pressure inside the vial container is positive. Additionally, there is a possibility that the medicine leaks from the needle hole. The reason for this leakage of the medicine is that, when the pressure inside the vial container is negative, force is applied from the syringe to the medicine inside the vial container.

To solve the above problems, there is a known technique of using a medicine-storing container including: a container body being a hard tubular body; and a flexible bag body disposed inside the container body, in which powdery medicine is contained inside a medicine storing space surrounded by the container body and the bag body (see, for example, International Patent Publication No. WO/2010/122872 (hereinafter "Patent Document 1")). In this medicine-storing container disclosed in Patent Document 1, a syringe filled with dissolving liquid that dissolves the medicine can be connected to a mouth section of the container body. Further, the bag body can be reversed inside and outside (reversed to front and back) by operating the syringe to perform discharging and sucking in this connected state. As a result, a rise (increase) or a drop (decrease) of the inner pressure of the medicine containing space can be suppressed.

Further, the bag body may take a first state in which the bag body expands toward a distal end side, and a second state in which the bag body expands toward a proximal end side when the bag body is reversed as described above.

Further, a stepped section, at which the inside diameter and the outside diameter are rapidly changed, is located at a position halfway of the axial direction of the container body. The container body is divided into a diameter-reduced section on the distal end side and a larger-diameter section on the proximal end side, interposing the stepped section as a boundary. Further, the bag body is positioned inside the diameter-reduced section and protected inside the diameter-reduced section in the first state, and is positioned in the larger-diameter section and protected the larger-diameter section in the second state.

However, according to the medicine container disclosed in Patent Document 1, in the unused state, the bag body is in the first state and positioned in the diameter-reduced section of the container body, and the larger-diameter section of the container body does not substantially function to protect the bag body. Therefore, depending on the use state of the medicine container, more specifically, depending on whether the medicine container is the unused state or the in-use state (during operation), the larger-diameter section may be the part unnecessary. Moreover, the entire length of the medicine container is elongated by the length of the larger-diameter section, and there are cases in which a relatively large storage area is occupied by the medicine container in the unused state.

SUMMARY

According to one aspect, a medical container comprises a container body that is a tubular body, wherein the container body includes a distal end opening opened at a distal end, a proximal end opening opened at a proximal end, and a proximal-end edge portion which surrounds the proximal end opening, wherein a liquid can flow through the distal end opening. A plug body contacts the distal end opening to form a liquid-tight seal, and a bag body includes an edge portion fixed to the proximal-end edge portion in a fluid-tight connection, with the bag body sealing the proximal end opening, and the bag body including a reversing part surrounded by the edge portion. The reversing part is reversed inside/outside when the liquid enters and exits the through the distal end opening by which the reversing part is positionable in a first state in which the reversing part expands towards a distal end side and a second state in which the reversing part expands toward a proximal end side. A tubular protection cover is positionable in a proximal end side mounting state in which the protection cover is mounted on the container body and covers the proximal end opening, and a distal end side mounting state in which the protection cover is mounted on the container body and covers the distal end opening, and in the proximal end side mounting state, the protection cover covers the bag body in the second state.

The reversing part is in the first state when the liquid flows in a direction away from the proximal end, and the reversing part is in the second state when the liquid flows towards the proximal end side The medical container disclosed here by way of example, may also include a tubular protection cover which can take a proximal end side mounting state in which the protection cover is mounted on the container body so as to cover the proximal end opening, and a distal end side mounting state in which the protection cover is mounted on the container body so as to cover the distal end opening, and in the proximal end side mounting state, the protection cover can cover the bag body in the second state.

Further, in the medical container in the distal end side mounting state, the protection cover can function as a cap to cover the distal end opening of the medical container in an unused state.

Additionally, in the medical container, the protection cover is mounted by being screw-engaged with the container body in both the proximal end side mounting state and the distal end side mounting state.

Further, in the medical container, a screwing amount to screw-engage the protection cover in the proximal end side mounting state is larger than a screwing amount to screw-engage the protection cover in the distal end side mounting state.

Additionally, in the medical container, the protection cover is mounted by being engaged with the container body in both the proximal end side mounting state and the distal end side mounting state.

Further, in the medical container, a distal end side flange and a proximal end side flange are at a part of the distal end side and a part of the proximal end side of an outer peripheral portion of the container body respectively, and each of the flanges is projected in a ring shape in a circumferential direction of the outer peripheral portion of the container body, the protection cover includes a plate-shaped portion having a plate-like shape, and a wall section which is erected from an edge portion of the plate-shaped portion and has a cylindrical shape, and an engagement section is on an inner peripheral portion of the wall section, and in the proximal end side mounting state, the engagement section is engaged with the proximal end side flange, and in the distal end side mounting state, engaged with the distal end side flange.

Additionally, in the medical container, the wall section includes a plurality of plate pieces arranged around an axis of the wall section and separated one another, and the engagement section is on at least one plate piece out of the plurality of plate pieces.

Further, in the medical container, at least one of the container body and the protection cover includes a restricting section to restrict the protection cover in the proximal end side mounting state from moving in the distal end direction.

Additionally, in the medical container, in the distal end side mounting state, a removable gas barrier sheet is joined to the proximal end opening in and the gas barrier sheet seals the proximal end opening and does not transmit oxygen and/or water vapor.

Further, in the medical container, at least one of the container body and the protection cover includes a communication part such that the inside and outside of the protection cover communicate with each other in the proximal end side mounting state.

Additionally, in the medical container, the bag body is separated from the inner peripheral portion of the container body in both the first state and the second state.

Additionally, in the medical container, the syringe filled with liquid is connectable to the distal end opening via a connector in the proximal end side mounting state, and the container body includes a rotation preventing means which prevents the connector from rotating about the axis of the distal end opening when the connector is connected to the distal end opening.

Further, in the medical container, the space is preliminarily filled with a medicine.

When the medical container is in an unused state, the protection cover can take the proximal end side mounting state when the bag body has to be covered later during a period from start to end of use. As a result, in the medical container, it is possible to omit the member that covers the bag body even when the bag body does not have to be covered, and the medical container becomes advantageous to miniaturization by the volume of the member omitted.

According to another aspect, a medical container includes: a tubular container body that includes a distal end opening open at a distal end of the container body, a proximal end opening open at a proximal end of the container body, and a proximal-end edge portion surrounding the proximal end opening, wherein a liquid can flow through the distal end opening; a plug body sealing the distal end opening in a liquid-tight manner; and a bag body including an edge portion fixed to the proximal-end edge portion in a fluid-tight connection, with the bag body sealing the proximal end opening of the container body, and the bag body including a reversing part surrounded by the edge portion, wherein the reversing part is flexible and configured to switch from a first state to a second state. The reversing part expands towards the distal end in the first state and expands towards the proximal end in the second state, and a space is surrounded by the container body, the plug body, and the bag body. A tubular protection cover is mountable on the container body in both a proximal end side mounting state in which the protection cover is mounted on the container body and covers the proximal end opening, and a distal end side mounting state in which the protection cover is mounted on the container body and covers the distal end opening, and in the proximal end side mounting state, the protection cover covers the bag body in the second state. The reversing part is in the first state when the liquid flows into the space, and the reversing part is in the second state when the liquid flows away from the space.

Another aspect involves a method of extracting medicine from a medical container, wherein the medical container comprises: a container body possessing a distal end opening opened at a distal end, a proximal end opening opened at a proximal end, and a proximal-end edge portion surrounding the proximal end opening; a plug body sealing the distal end opening; a bag body including an edge portion fixed to the proximal-end edge portion in a fluid-tight connection, the bag body sealing the proximal end opening, and the bag body including a flexible reversing part surrounded by the edge portion, and a space surrounded by the container body, the plug body, and the bag body, and a medicine stored in the space. The method comprises: mounting a cover on the proximal end of the container body so that the cover covers the proximal end opening of the container body, with the cover being mounted on the container body while the reversing part is in a first state in which an apex portion of the reversing part is positioned entirely in the cylinder body and an apex of the reversing portion is closer to the distal end of the container body than the proximal end of the container body. The method further involves adding a liquid to the space in which the medicine is stored by inserting a syringe through the plug body, with the adding of the liquid to the space switching the reversing part from the first state to a second state in which the apex portion of the reversing part is positioned entirely in the cover and the apex of the reversing part is closer to the proximal end of the container body than the distal end of the container body. In addition, the method includes mixing the medicine stored in the space with the liquid introduced into the space from the syringe to obtain a mixed liquid, and removing the mixed liquid from the space.

DETAILED DESCRIPTION

Figure 1:
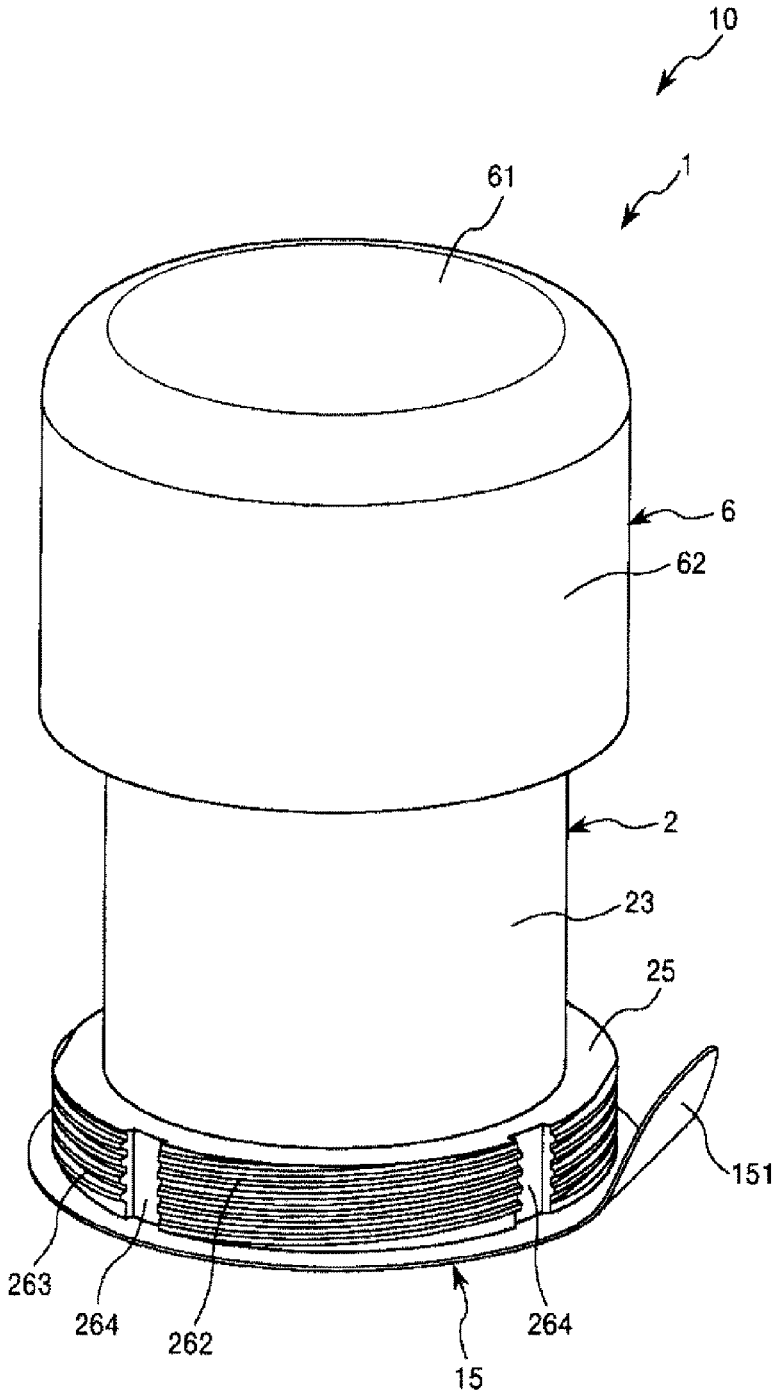
FIG. 1 is a perspective view showing a medical container in an unused state according to an embodiment.

An embodiment of a medical container representing an example of the medical container disclosed here is set forth below with reference to the accompanying drawings.

In the following, for convenience of description, the lower side in FIGS. 1 to 5 (also in FIGS. 7 to 10) will be referred to as "proximal end side" or "lower side (downward)" and the upper side therein as "distal end side" or "upper side (upward)".

As shown in FIGS. 1 to 5, a medical device set 10 includes a medical container 1. Also, the medical device set 10 includes a syringe 20 and a connector (adapter) 30 besides the medical container 1. The configuration of each of the components will be described below.

The medical container 1 includes a container body 2, a plug body 3, a bag body (balloon) 4, and a protection cover 6. Further, a powdery or liquid medicine P (powdery medicine in the present embodiment) is preliminarily contained inside the medical container 1. This medicine P is mixed with a liquid Q, such as a dissolving liquid, a diluting liquid, and a medicinal solution, supplied from a syringe 20. This mixture is to be a medicinal liquid R.

Though not specifically restricted, examples of the medicine P include: medicines which are dangerous if erroneously touched by a medical worker, such as carcinostatic agents and/or immunosuppressant; medicines which have be dissolved in use, such as antibiotic and/or styptic; medicines which need dilution, such as pediatric drugs; medicines which need multi-time dispensing, such as vaccine, heparin, and/or pediatric drugs; medicines, such as protein preparation, which are easily foamed when dissolving or when sucked into the syringe; and medicines, such as anti-body drug, in which a small quantity medicine is contained. In addition, though not specifically restricted, an example of the liquid Q may be physiological saline.

Figure 2:
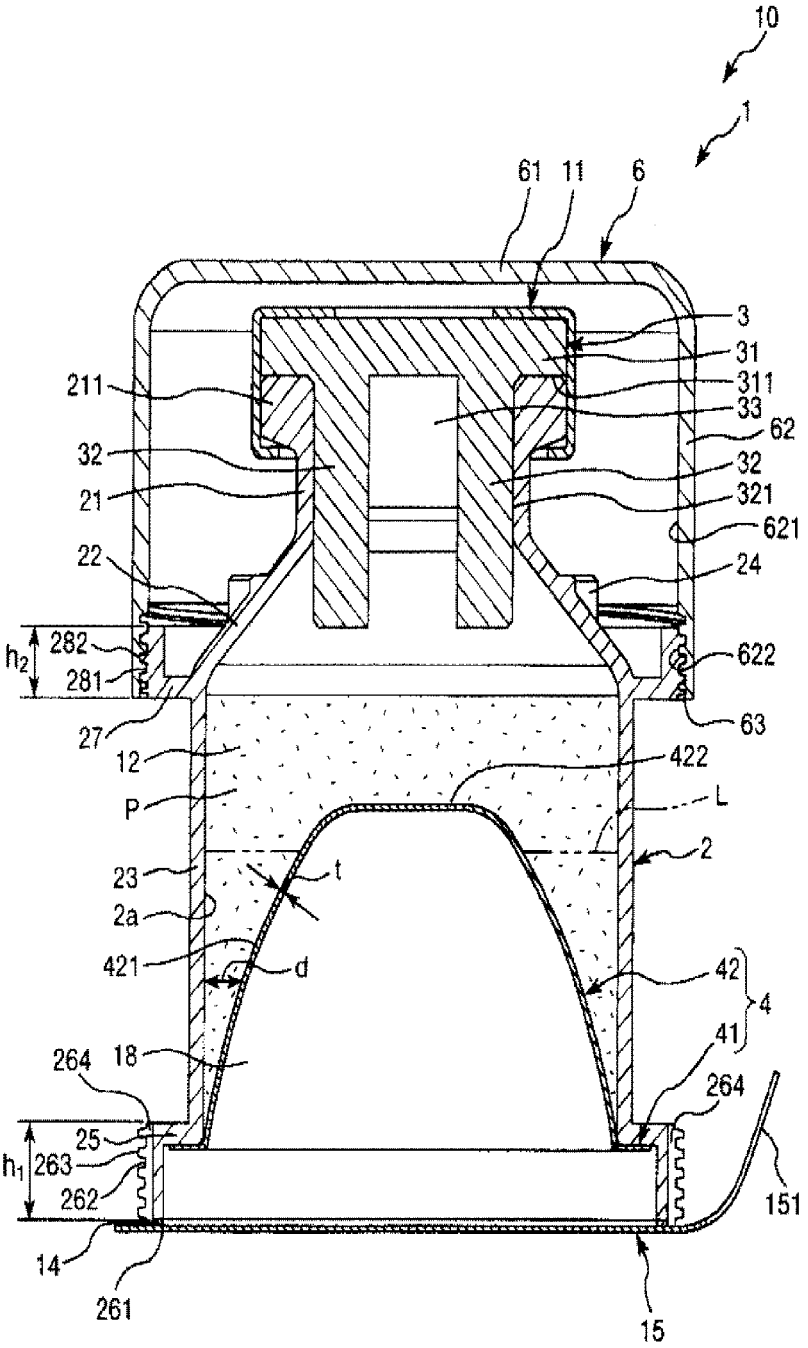
FIG. 2 is a longitudinal sectional view of the medical container shown in FIG. 1.
Figure 4:
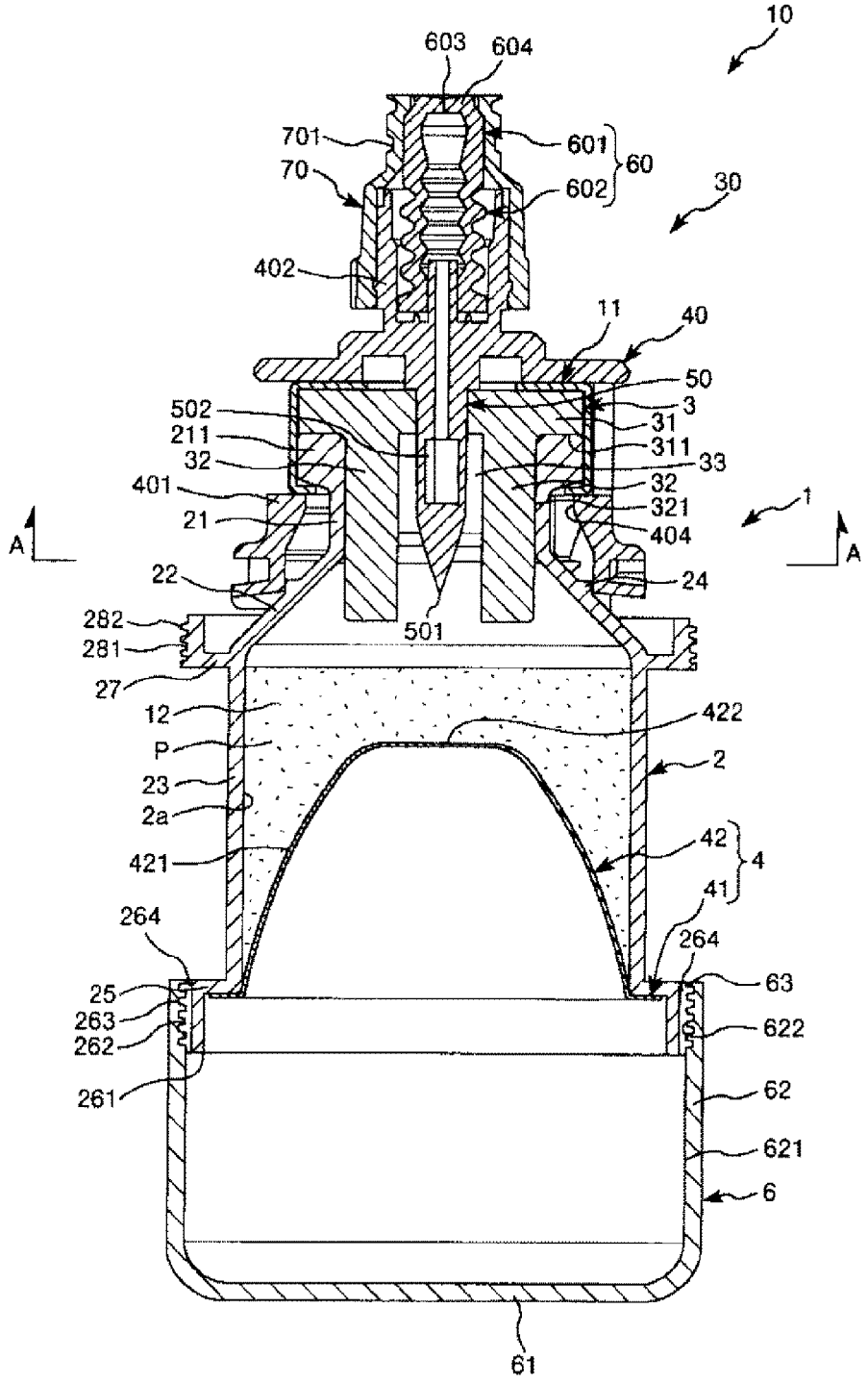
FIG. 4 is a longitudinal sectional view showing the medical container (first embodiment) during operation.
Figure 5:
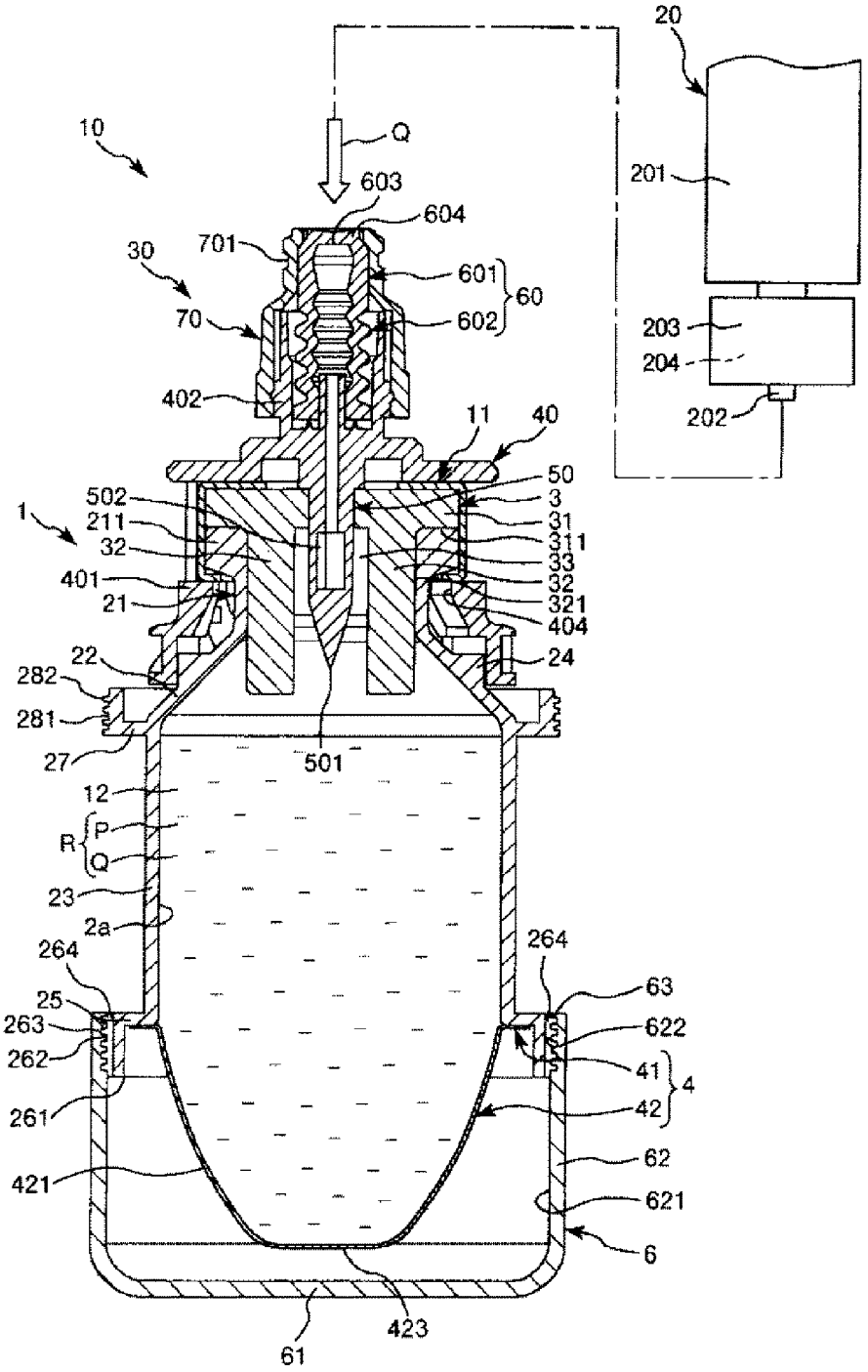
FIG. 5 is a longitudinal sectional view showing the medical container (first embodiment) during its operation.

As shown in FIGS. 2, 4 and 5, the container body 2 is a cylindrical body which includes a distal end opening opened at the distal end and functions as a mouth section 21 through which liquid can enter and exit, and a proximal end opening 261 opened at the proximal end. The container body 2 can be divided, by the inside diameter size, into a mouth section 21, a shoulder section 22, and a barrel section 23 sequentially from the distal end side.

As it will be described below, a protection cover 6 is detachably mounted on the container body 2 so as to cover the mouth section 21 from the distal end side (see FIGS. 1 and 2), and also detachably mounted so as to cover the proximal end opening 261 from the proximal end side (see FIGS. 4 and 5). In the following, the former mounting state is referred to as "distal end side mounting state" and the latter mounting state is referred to as "proximal end side mounting state".

The inside diameter of the mouth section 21 is constant along an axial direction, and is smaller than the inside diameter of the barrel section 23. As shown FIGS. 4 and 5, the connector 30 can be mounted on the mouth section 21 in the proximal end side mounting state, and the syringe 20 is connected via this connector 30. Further, when the syringe 20 is operated while thus connected, the liquid Q flows from the syringe 20 (see FIG. 5) or the medicinal liquid R flows out to the syringe 20 via the mouth section 21.

Additionally, a ring-shaped projected section 211 projects on an outer peripheral portion of the mouth section 21 along the circumferential direction of the mouth section 21.

Figure 3:
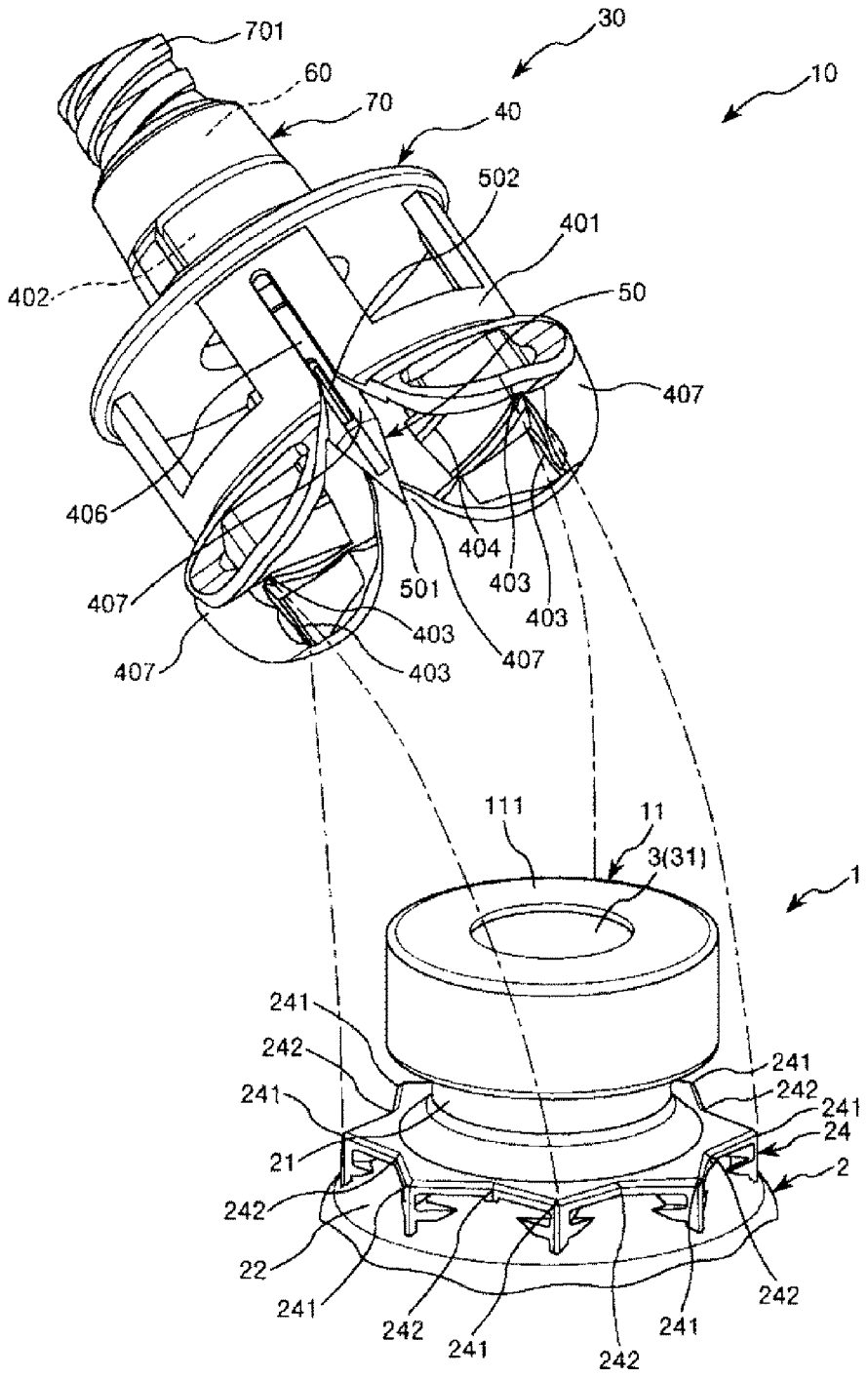
FIG. 3 is a view showing the medical container mounted with a connector.

The inside diameter of the shoulder section 22 gradually increases in the proximal end direction. As shown in FIG. 3, a rotation preventing projection 24 protrudes upward on an outer peripheral portion of this shoulder section 22. This rotation preventing projection 24 controls a position of the connector 30 around the axis of the connector 30, and functions as a rotation preventing means that prevents the connector 30 from rotating about the axis of the container body 2 (mouth section 21) when the connector 30 is connected to the mouth section 21. The rotation preventing projection 24 has a polygonal shape from the top view, and includes eight corner sections 241 projected outward and eight corner sections 242 recessed inward. The corner sections 241 and the corner sections 242 are arranged alternately around the axis of the container body 2.

The barrel section 23 has an inside diameter (average) larger than the inside diameter of the mouth section 21.

The proximal end opening 261 and a proximal-end edge portion (proximal end side flange) 25 surrounding the proximal end opening 261 are located on the proximal end side of the outer peripheral portion of this barrel section 23. The proximal-end edge portion 25 is ring-shaped along the circumferential direction of the barrel section 23. Also, on an outer periphery of the proximal-end edge portion 25, a proximal-end outer peripheral portion 262 projects in the proximal end direction orthogonally to the proximal-end edge portion 25, and covers the entire outer periphery of the proximal-end edge portion 25. The proximal-end edge portion 25 and the proximal-end outer peripheral portion 262 are formed like a flange as a whole.

As shown in FIGS. 1, 2, 4 and 5, a male screw 263 is provided on the proximal-end outer peripheral portion 262. As it will be described below, the container body 2 can be screw-engaged with the protection cover 6 which is to be the proximal end side mounting state, using this male screw 263.

Further, a plurality of grooves (communicating parts) 264 (four grooves in the present embodiment) extending along the axial direction of the container body 2 are located on the proximal-end outer peripheral portion 262 to break a part of the male screw 263. These grooves 264 are arranged at intervals of equal angle around the axis of the container body 2. Further, in the proximal end side mounting state shown in FIGS. 4 and 5, the inside and outside of the protection cover 6 communicate with each other through each groove 264, so that the air can enter and exit the protection cover. With this configuration, when the reversing part 42 of the bag body 4 is changed to the second state from the first state, the air between the bag body 4 and the protection cover 6 is pushed out, and vice versa, the air between the bag body 4 and the protection cover 6 is sucked. As a result, the reversing part 42 can be easily and reliably reversed.

As shown in FIGS. 2, 4 and 5, a ring portion (distal end side flange) 27, projected in a ring-shape is located at a boundary between the shoulder section 22 and the barrel section 23 in the container body 2 in the circumferential direction of the container body 2. Also, on an outer periphery of the ring portion 27, a distal-end outer peripheral portion 281 that covers the entire outer periphery of the ring portion 27 projects in the distal end direction orthogonally to the ring portion 27. The ring portion 27 and the distal-end outer peripheral portion 281 are formed like a flange as a whole.

A male screw 282 is formed on the distal-end outer peripheral portion 281. As it will be described below, the container body 2 can be screw-engaged with the protection cover 6 which is to be mounted in the distal end side mounting state, using this male screw 282.

The material constituting the container body 2 and the protection cover 6 is not specifically restricted. Examples of the material include following resin materials such as: polyolefins such as polyethylene, polypropylene, and/or cyclic polyethylene; polyesters such as polyethylene terephthalate; vinyl resins such as vinyl chloride resin and/or polyvinyl alcohol; polyamide such as nylon 6, nylon 6.6, nylon 6.10, and/or nylon 6.12; and other thermoplastic resins. One of these examples or a combination of two or more of these examples may be used. Also, the material added with a light shielding additive may be used to cut a specific wavelength. Further, the inner surface of the container body 2 may be coated with, for example, Teflon ("Teflon" is the registered trademark) or fluorine, to avoid absorption of the medicine P. The respective components have transparency for securing visibility of the inside of these components.

A plug body 3 formed of an elastic material is mounted on the mouth section 21 of the container body 2. This ensures the mouth section 21 to be sealed in a liquid-tight manner.

The plug body 3 includes a top plate 31 formed of a disk-shaped plate, a pair of leg portions 32 projected from a proximal end surface 311 of the top plate 31, and a tubular section 33 provided between the top plate 31 and the pair of leg portions 32.

The pair of leg portions 32 comprise of plate pieces arranged apart and facing each other. Further, outer surfaces 321 of the leg portions 32 each are formed in an arc-shape along an inner peripheral portion of the mouth section 21. In a temporarily-plugged (half-plugged) state, in which the pair of the leg portions 32 are introduced into the mouth section 21 of the container body 2 but the tubular section 33 has not been inserted into the mouth section 21 of the container body 2 yet, the plug body 3 is reliably prevented from being detached from the mouth section 21. Further, when the pair of leg portions 32 are more deeply inserted into the mouth section 21 of the container body 2, the tubular section 33 contacts the inner peripheral surface of the mouth section 21. Thus, the mouth section 21 is liquid-tightly sealed.

Additionally, the mouth section 21 of the container body 2 is covered with a body cap 11 together with the plug body 3, and the body cap 11 is formed of, for example, aluminum. The body cap 11 is engaged with the projected section 211 of the mouth section 21. With this structure, the plug body 3 is more reliably prevented from being detached from the mouth section 21.

Examples of the elastic material constituting the plug body 3 include various rubber materials, such as natural rubber, isoprene rubber, butadiene rubber, styrene-butadiene rubber, urethane rubber, fluorine-contained rubber, and various thermoplastic elastomers based on styrene, polyolefin or the like, and one of these examples or a combination of two or more of these examples may be used.

As shown in FIGS. 2, 4, and 5, the bag body 4 according to the present embodiment has a bag-like shape, that is, has a cup-like shape (bowl-like shape) in a state of nature in which no external force is applied. Further, a space 12 to contain the medicine P is defined by the bag body 4, the container body 2, and the plug body 3 in the medical container 1. In this space 12, the medicine P is preliminarily contained. After aseptically filling a liquid composition containing the medicine P inside the space 12, the plug body 3 is inserted into the mouth section 21 so that the plug body 3 is in a temporarily-plugged state. Subsequently, the liquid composition is freeze-dried, and then the tubular section 33 of the plug body 3 is inserted into the mouth section 21 to liquid-tightly seal the mouth section 21. Thus, the medicine P is contained in the space 12.

The bag body 4 includes an edge portion 41 and a reversing part 42 surrounded by the edge portion 41.

The edge portion 41 is tightly fixed (i.e., in a liquid-tight manner) to the proximal-end edge portion 25 (inner peripheral portion 2*a*) at the proximal end of the container body 2. This edge portion 41 is supported by the proximal-end edge portion 25 such that the reversing part 42 folds an edge of the opening section of the bag-shaped bag body 4 outwardly. With this configuration, force is applied to the bag-shaped reversing part 42 in a direction (orthogonal to the axis of the container body 2) in which the reversing part 42 is reversed inside and outside (hereinafter referred to as "inside/outside") of the bag (the reversing part 42), that is, a front-side and back-side of the bag. As a result, the reversing part 42 can be stably and easily reversed.

In the case where the container body 2 in which the bag body 4 is set is placed alone on a table (stand) and the like such that the mouth section 21 is positioned on the upper side, the edge portion 41 which is to be a welding part between the bag body 4 and the container body 2 can be protected by the proximal-end outer peripheral portion 262 of the container body 2. For example, even when the container body 2 is directly placed on the table, the container body 2 contacts the table via the proximal-end outer peripheral portion 262. As a result, the welding part (edge portion 41) of the bag body 4 can be protected. Also, even when the container body 2 placed on the table is moved to a different position on the table, the welding part of the bag body 4 can be protected and prevented from being damaged in the same manner.

The above-described bag body 4 can be obtained by heating and deforming a flexible sheet material by using, for example, a mold. Examples of the molding method include vacuum molding and pressure molding, and particularly the vacuum molding by plug assist process is preferred. Further, the thickness t of this sheet material (bag body 4) is not specifically restricted. For example, preferably the thickness of the reversing part 42 is from 0.03 to 0.5 mm, and more preferably from 0.05 to 0.3 mm. Further, preferably the thickness of the edge portion 41 of the bag body 4 is, for example, from 0.05 to 0.7 mm, and more preferably from 0.07 to 0.4 mm. Additionally, the material constituting the sheet material is not specifically restricted, but examples include: polyolefin resin such as polyethylene, polypropylene, and/or cyclic polyethylene; blend resin or copolymerized resin including the polyolefin resin; polyester resin such as polyethylene terephthalate; polyamide resin such as nylon; single-layer film such as, polyvinylidene chloride, and/or vinyl chloride-polyvinylidene chloride copolymer; single-layer film obtained by vapor-depositing aluminum, silica, etc. onto the mentioned single-layer film; multilayer film obtained by laminating the mentioned single-layer films, other film, and metal foil such as aluminum. Particularly, the material having water-vapor barrier properties or oxygen barrier properties is preferable. By using the above-mentioned sheet material, the bag body 4 which is configured to be reversed (reversed inside/outside) can be reliably molded.

A method of fixing the proximal-end edge portion 25 of the container body 2 to the edge portion 41 is not specifically restricted. Examples of the method include: welding (such as thermal welding, RF welding, ultrasonic welding, and laser welding), and bonding (bonding with an adhesive or solvent). Among these methods, the welding method is more preferable.

The reversing part 42 is a portion which is reversed by the liquid Q flowing into the space 12 via the mouth section 21 of the container body 2 (see FIG. 5) and by the medicinal liquid R flowing out from the space 12. With the reverse of the reversing part, a rapid inner pressure change inside the space 12 can be suppressed when the syringe 20 performs discharging and sucking. As a result, discharging and sucking can be smoothly performed.

Additionally, the reversing part 42 may take two states: a first state, as shown in FIGS. 2 and 4, in which the reversing part 42 is expanded toward the distal end side; and a second state, as shown in FIG. 5, in which the reversing part 42 is expanded toward the proximal end side. In the unused state shown in FIG. 1, in which the medicine P is preliminarily contained in the space 12, the reversing part 42 is in the first state.

In the first state, the entire reversing part 42 is positioned (housed) inside the barrel section 23 of the container body 2. In the second state, the reversing part 42 protrudes in the proximal direction from the proximal end opening 261 of the container body 2. In the first state, the apex of the reversing part 42 is positioned in the cylinder body relatively closer to the distal end of the container body 2 than the proximal end of the container body 2. In the second state, the apex of the reversing part 42 is positioned in the cover relatively closer to the proximal end of the container body 2 than the distal end of the container body 2.

Additionally, in both the first state and the second state, a space-side surface 421 of the reversing part 42, which is the surface facing the space 12 side, is separated from an inner peripheral portion 2*a* of the container body 2. In this instance, a separation distance d gradually increases along the axial direction of the container body 2 in a direction away from the edge portion 41. In other words, the distance d gradually increases in a distal end direction in the first state, and in a proximal end direction in the second state.

It is preferable that 90% of an entire surface area of the space-side surface 421 of the reversing part 42 be separated from the inner peripheral portion 2*a* of the container body 2, and it is more preferable that 95 to 100% of the entire surface area of the space-side surface 421 of the reversing part 42 be separated from the inner peripheral portion 2*a* of the container body 2.

With the above-described configuration of the reversing part 42, when the medicinal liquid R inside the space 12 is sucked to be collected to the syringe 20, the reversing part 42 takes the first state, and the space between the space-side surface 421 of the reversing part 42 and the inner peripheral portion 2*a* of the container body 2 is enlarged toward the mouth section 21 of the container body 2. With this configuration, the medicinal liquid R can reliably and easily flow down to the mouth section 21 through the above-described space. As a result, a prescribed amount of the medicinal liquid R can be sufficiently, reliably and easily collected.

Here, in the case where the space-side surface 421 of the reversing part 42 contacts (or is in close contact with) the inner peripheral portion 2*a* of the container body 2 at the time of collecting the medicinal liquid R, the medicinal liquid R enters between the space-side surface 421 of the reversing part 42 and the inner peripheral portion 2*a* of the container body 2 due to the capillary phenomenon, and may not be sucked and remain therebetween. In such a case, the prescribed amount of the medicinal liquid R cannot be collected. In other words, the amount of the collected medicinal liquid R is short by the remaining amount.

Therefore, separation of the reversing part 42 from the container body 2 improves a collection rate of the medicinal liquid R.

For example, assume that 10 cc of the liquid Q is filled in the space 12 from the syringe 20. This filling amount is a target amount of the medicinal liquid to be collected by the collecting operation. When the liquid Q is filled, the reversing part 42 is reversed from the first state to the second state and expands by the filling amount of the liquid Q (10 cc). Then, after the liquid Q is mixed with the medicine P by shaking, collecting is executed. The reversing part 42 is reversed from the second state to the first state by collecting, and can be returned to the original state by the filling amount, namely, the amount to be collected (target amount) of medicinal liquid. In this instance, the reversing part 42 is separated from the container body 2. Thus, the target amount of the medicinal liquid R can be easily and stably collected.

Additionally, in the unused state shown in FIG. 2, the medicine P contacts the entire part of the space-side surface 421 in the first state, and a clearance is generated between the reversing part 42 and the medicine P when the reversing part 42 is reversed from the first state. With this configuration, the liquid Q enters the clearance between the reversing part 42 and the medicine P when the liquid Q is filled into the space 12 from the syringe 20. Therefore, a widest contact area can be secured between the liquid Q and the medicine P. As a result, mixing of the liquid Q with the medicine P is sufficiently and reliably performed and an effect of shortening a time required for dissolving the medicine P with the liquid Q can be obtained.

Even in the case where the medicine P is filled merely up to the level indicated by a two-dot dashed line (virtual line L) in FIG. 2 (in the case where the medicine P does not contact the entire surface of the reversing part 42, namely, the entire part of the space-side surface 421), the clearance is generated between the reversing part 42 and the medicine P when the reversing part 42 is reversed. Therefore, the contact area of the liquid Q and the medicine P is enlarged. In other words, the same effect can be obtained as long as the medicine P at least partly contacts a proximal end side of the space-side surface 421 in the first state.

In both the first state and the second state, a center portion of the reversing part 42 located on the other side of the edge portion 41 has a flat shape. More specifically, the center portion corresponds to a top portion 422 in the first state and a bottom portion 423 in the second state. Because of this flat shape, a volume of the space 12 in the unused state (first state) can be increased without enlarging the container body 2. Additionally, by forming this flat top portion 422 thicker and more constant than a surrounding area of the flat top portion 422, the reversing part 42 can be homogeneously reversed when the reversing part 42 is reversed from the first state to the second state because reversing starts from the surrounding area of the top portion 422.

As shown in FIG. 2, in the distal end side mounting state, a gas barrier sheet 15 is joined to the proximal end surface of the proximal-end outer peripheral portion 262 of the container body 2 via, for example, a bonding layer 14 so as to block the proximal end opening 261. This gas barrier sheet 15 does not transmit water vapor and oxygen. Examples of the material for the gas barrier sheet 15 include: polyolefin resin such as polyethylene, polypropylene, cyclic polyethylene; blend resin or copolymerized resin including the polyolefin resin; polyester resin such as polyethylene terephthalate; polyamide resin such as nylon; a single-layer film such as polyvinylidene chloride, vinyl chloride-polyvinylidene chloride copolymer; a single-layer film obtained by vapor-depositing aluminum, silica, etc. onto the above-mentioned films; a multilayer film obtained by laminating the above-mentioned single-layer film, another film, and metal foil such as aluminum.

The gas barrier sheet 15 keeps the gas barrier properties inside a space 18 on the proximal end side better than the gas barrier properties of the bag body 4 inside the container body 2, thereby preventing oxygen and water vapor from entering the space 12 through the space 18. With this configuration, degradation of the medicine P preliminarily contained in the space 12 can be reliably prevented.

As shown in FIGS. 4 and 5, the gas barrier sheet 15 is peeled off from the protection cover 6 during the operation of the medical container 1, more specifically, in the proximal end side mounting state. To facilitate this peeling operation, a tab 151 is provided as a holding part at an edge portion of the gas barrier sheet 15.

As shown in FIG. 5, the syringe 20 is preliminarily filled with the liquid Q to be mixed with the medicine P. This syringe 20 includes an outer tube 201. The outer tube 201 has a bottomed tube-like shape, and a mouth section 202 projected in the distal end direction is formed on a bottom portion of the outer tube.

Also, the syringe 20 includes a gasket (not shown) liquid-tightly slidable inside the outer tube 201, and a plunger (not shown) connected to the gasket and used to move the gasket inside the outer tube 201. Further, the liquid Q can be discharged from the mouth section 202 using the gasket by pushing the plunger.

Additionally, a ring-shaped lock member (lock adapter) 203 is disposed concentrically with the mouth section 202 on an outer peripheral side of the mouth section 202. A female screw 204 to be screw-engaged with the connector 30 is located on an inner peripheral portion of the lock member 203 in the proximal end side mounting state. Further, the syringe 20 is connected to the connector 30 by this screw-engagement. The lock member 203 may be integrally formed with the mouth section 202, or may be formed separately from the mouth section 202. In the case where the lock member 203 is formed separately from the mouth section 202, the lock member 203 may be movably supported along the axial direction of the mouth section 202, or may be movably supported about the axis of the mouth section 202.

The above-described syringe 20 is connected to the medical container 1 in the proximal end side mounting state via the connector 30.

As shown in FIGS. 3 to 5, the connector 30 includes a main body 40, a bottle needle 50, a valve body 60, and a cap 70.

The main body 40 includes a mounting section 401 to be mounted on the mouth section 21 of the container body 2, and a valve body installation section 402 where the valve body 60 is installed.

The mounting section 401 has a tubular shape, and can be fitted with the mouth section 21 of the container body 2 from the outside of the mouth section 21.

Figure 6:
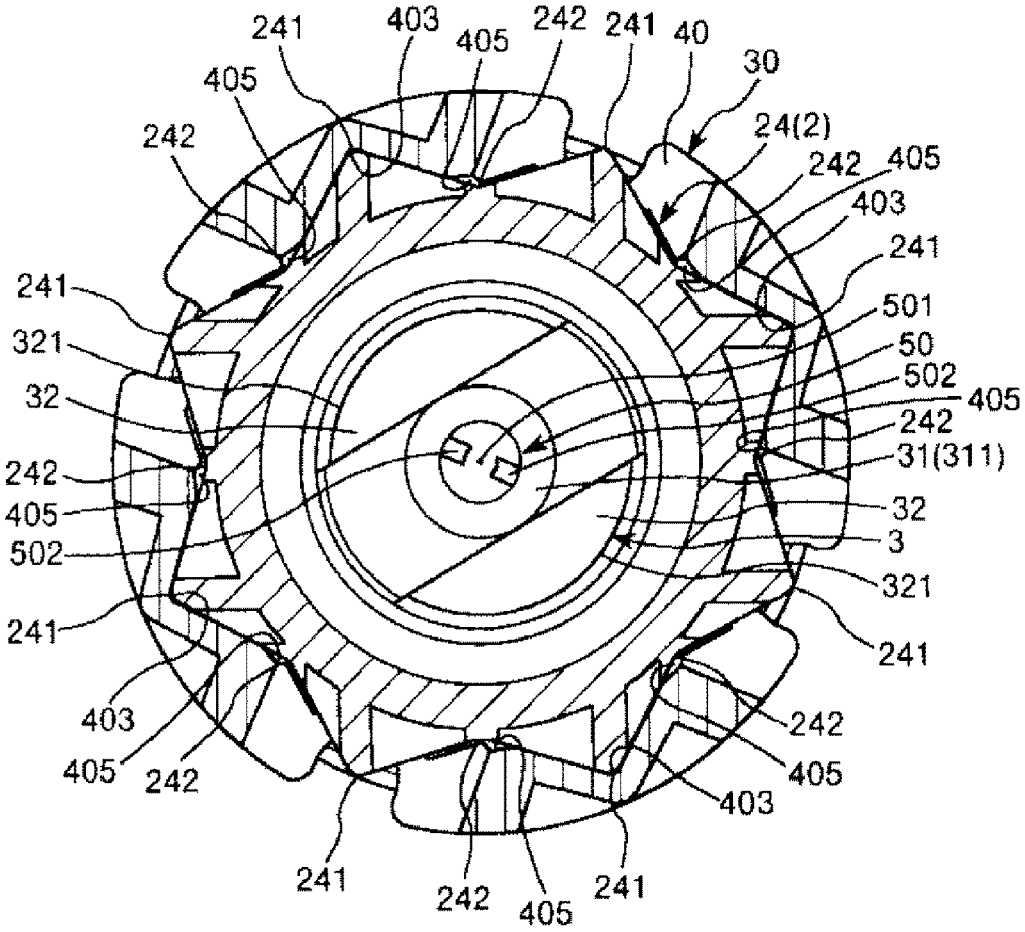
FIG. 6 is a cross-sectional view taken along a line A-A in FIG. 4.

Additionally, a plurality of corner sections 403 are formed on the inner peripheral portion of the mounting section 401 and recessed outward (four corner sections are formed in the configuration shown in FIGS. 3 and 6). These corner sections 403 are arranged at intervals of equal angle around the axis of the mounting section 401. Additionally, corner sections 405 project inwardly on both sides of each corner section 403 and (see FIG. 6).

Further, as shown in FIG. 6, when the mounting section 401 is mounted on the mouth section 21 of the container body 2, the four corner sections 403 are respectively fitted (inserted) into four corner sections 241 out of the eight corner sections 241 of the rotation preventing projection 24 of the container body 2. With this configuration, the connector 30 is reliably prevented from rotating about the axis of the container body 2, and the syringe 20 can be easily connected to the connector 30 by screw-engagement. Even though the corner sections 405 of the mounting section 401 may abut on (or hit) the corner sections 241 of the container body 2 when the mounting section 401 is mounted on the mouth section 21 of the container body 2, the corner sections 405 are guided by the corner sections 241, and the mounting section 401 rotates about the axis of the corner sections 241 because of this abutting. By this rotation, the respective four corner sections 403 are reliably fitted into the four corner sections 241 out of the eight corner sections 241 of the rotation preventing projection 24 of the container body 2, as described above. Thus, the connector 30 can be prevented from rotating about the axis of the container body 2.

Additionally, as shown in FIGS. 4 and 5, pawls 404 project on the inner peripheral portion of the mounting section 401 in close proximity of the distal end side of the respective corner sections 403. When the mounting section 401 is fitted to the mouth section 21 of the container body 2, each pawl 404 is engaged with the projected section 211 of the mouth section 21. With this configuration, the connector 30 can be reliably prevented from unexpectedly being disengaged from the container body 2.

As shown in FIG. 3, the mounting section 401 includes slits 406 extending along the axial direction of the mounting section 401, and each slit is formed between the adjacent corner sections 403. These slits allow the mounting section 401 to expand in a radial direction when the pawls 404 climb over the projected section 211 of the mouth section 21 in the process of fitting the mounting section 401 to the mouth section 21. In this manner, the mounting section 401 can be easily mounted.

Further, an enlarged width section 407 that has the width becoming enlarged toward the proximal end side is formed on the proximal end section of each slit 406. Each of the corner sections 241 of the rotation preventing projection 24, which is not engaged with the corner sections 403 of the mounting section 401, can enter each of the enlarged width sections 407.

The valve body installation section 402 has a tubular shape smaller than mounting section 401, and the valve body 60 can be inserted into the valve body installation section.

The bottle needle 50 is disposed concentrically with the mounting section 401. This bottle needle 50 includes a sharp needlepoint 501 that can thrust through the top plate 31 of the plug body 3 of the medical container 1. Also, the bottle needle 50 is a hollow needle and includes at least one side hole 502 (two side holes in the present embodiment) opened on the side surface of the bottle needle 50.

The valve body 60 is a tubular elastic body, and can be divided into a head section 601 on the distal end side and a barrel section 602 on the proximal end side. The head section 601 includes a top plate 604 on which a slit 603 having self-closing property is formed. When the syringe 20 is connected to the connector 30, the mouth section 202 of the syringe 20 presses the top plate 604 and deforms the top plate, thereby opening the slit 603. In the case where the syringe 20 starts discharging or sucking in this state, the liquid can flow between the syringe 20 and the medical container 1 via the valve body 60 and the bottle needle 50. Further, when the syringe 20 is detached from the head section 601, the syringe pressing force against the top plate 604 is released, thereby closing the slit 603.

The barrel section 602 has a bellows shape, and functions as a biasing section for biasing the head section 601 in the distal end direction. As a result, while the syringe 20 is detached, the head section 601 can stay in a designated position with respect to the cap 70.

The cap 70 is a tubular member covering the valve body 60. The proximal-end inner peripheral portion of this cap 70 is joined to the outer peripheral portion of the valve body installation section 402 of the main body 40. Also, the distal-end outer peripheral portion of the cap 70 can compress the top plate 604 of the head section 601 of the valve body 60 located at the designated position. This reliably closes the slit 603.

Further, a male screw 701 is located on the outer peripheral portion of the cap 70. The female screw 204 of the lock member 203 of the syringe 20 can be screw-engaged with the male screw 701.

As described above, the protection cover 6 that can take the distal end side mounting state and the proximal end side mounting state is detachably mounted on the container body 2.

As shown in FIGS. 1, 2, 4 and 5, the protection cover 6 includes a plate-shaped portion 61 having a disk-like shape, and a wall section 62 which is erected (projected) from an edge portion of the plate-shaped portion 61 and has a cylindrical shape along the circumferential direction of the plate-shaped portion 61. An opposite side of the plate-shaped portion 61 of the protection cover 6 is opened, and an opening 63 is formed.

A female screw 622 is located on the side of the opening 63 of an inner peripheral portion 621 of the wall section 62. This female screw 622 can be screw-engaged with any one of the male screws 282 and 263 of the container body 2. Further, when the female screw 622 is screw-engaged with the male screw 282 of the container body 2, the protection cover 6 is in the distal end side mounting state, and when the female screw 622 is screw-engaged with the male screw 263 of the container body 2, the protection cover 6 is in the proximal end side mounting state.

As shown in FIG. 2, in the distal end side mounting state, more specifically, in the state in which the protection cover 6 is released from the proximal end side mounting state and separated from the proximal end opening 261 of the container body 2, the protection cover 6 functions as a cap that covers the mouth section 21 including the plug body 3 when the medical container 1 is in the unused state. This configuration can reliably prevent, for example, an operator's finger from unexpectedly touching the mouth section 21 or the plug body 3.

As shown in FIG. 5, in the proximal end side mounting state, more specifically, in the state in which the protection cover 6 is released from the distal end side mounting state and separated from the mouth section 21 of the container body 2, the protection cover 6 can cover the bag body 4 in the second state. This configuration can reliably protect the bag body 4.

Thus, in the medical container 1, the protection cover 6 that covers the bag body 4 doubles as the cap that covers the mouth section 21. Additionally, when the medical container 1 is in the unused state, the protection cover 6 can be provided in one of the distal end side mounting state and the proximal end side mounting state depending on which component, the bag body 4 or the mouth section 21, is to be covered or not to be covered during a period from start to end of use. As a result, in the medical container 1, it is possible to omit a member that covers a component unnecessary to be covered, and therefore the medical container is advantageous to miniaturization by the volume of the member omitted therefrom.

Additionally, the protection cover 6 is mounted by screw-engagement with the container body 2 via the female screw 622 in both the distal end side mounting state and the proximal end side mounting state. Thus, using "screw-engagement" for mounting makes it possible to easily mount and detach the protection cover 6 on/from the container body 2 by simple screwing operation.

As described above, in the container body 2, the male screw 282 is located on the distal-end outer peripheral portion 281, and the male screw 263 is located on the proximal-end outer peripheral portion 262. A height h1 of the proximal-end outer peripheral portion 262 is higher than a height h2 of the distal-end outer peripheral portion 281. Accordingly, a screwing amount to screw-engage the protection cover 6 with the male screw 263 in the proximal end side mounting state is larger than (or different from) a screwing amount to screw-engage the protection cover 6 with the male screw 282 in the distal end side mounting state. Thus, because of the different screwing amount generated between the respective states, screw-engagement between the protection cover 6 and the container body 2 can be quickly released when the protection cover 6 in the distal end side mounting state is detached from the container body 2. Therefore, detachment can be smoothly carried out. Additionally, when the protection cover 6 is mounted on the container body 2 to take the proximal end side mounting state afterward, the proximal end side mounting state is more solid than the distal end side mounting state.

Next, a method of operating the medical device set 10 (medical container 1) will be described with reference to FIGS. 1 to 5.

First, as shown in FIG. 1, the medical container 1 which is in the unused state and preliminarily containing the medicine P in the space 12 is prepared. As shown in FIG. 2, the protection cover 6 in the unused-state medical container 1 is in the distal end side mounting state.

Thereafter, the protection cover 6 is detached from the container body 2 by unscrewing the screw-engagement between the male screw 282 of the container body 2 and the female screw 622 of the protection cover 6. Thus, the distal end side mounting state is released.

Also, the gas barrier sheet 15 is peeled off from the container body 2 with the tab 151 of the gas barrier sheet 15 being held.

Next, as shown in FIG. 3, the container body 2 from which the protection cover 6 has been detached is placed, for example, on a table (not shown) such that the mouth section 21 faces upward. After that, the connector 30 is brought near the mouth section 21 and pressed so as to be mounted on the mouth section 21 of the container body 2 from the top. In this instance, the four corner sections 241 of the rotation preventing projection 24 of the container body 2 are fitted with the four corner sections 403 of the main body 401 of the connector 30, whereby rotation of the connector 30 is restricted with respect to the container body 2.

Subsequently, as shown in FIG. 4, the detached protection cover 6 is mounted on the container body 2 to be mounted in the proximal end side mounting state. Here, the protection cover 6 is mounted by screw-engaging the female screw 622 of the protection cover 6 with the male screw 263 of the container body 2. The order of the above two steps may be reversed. That is, the mounting of the protection cover 6 on the container body 2 to be mounted in the proximal end side mounting state can be performed before the connector 30 is mounted on the mouth section 21.

Next, as shown in FIG. 5, the syringe 20 is connected to the connector 30 mounted on the mouth section 21 of the container body 2 (hereafter, this state is referred to as "connected state"). The above connecting work is carried out by screw-engaging the female screw 204 of the lock member 203 of the syringe 20 with the male screw 701 of the cap 70 of the connector 30. Further, at the time of this connecting work, rotation of the connector 30 is restricted with respect to the container body 2 as described above. Therefore, the connecting work can be reliably carried out. Further, in the connected state, the slit 603 of a valve body 60 of the connector 30 is put into an opened state as described above.

Next, the plunger of the syringe 20 is pushed during the connected state, and the liquid Q is supplied from the syringe 20 into the space 12 of the medical container 1. This liquid Q flows down through the valve body 60 and the bottle needle 50, and flows into the space 12 through the side hole 502 of the bottle needle 50. Thus, the liquid Q is mixed with the medicine P, and the medicinal liquid R starts to be generated.

Further, the reversing part 42 of the bag body 4 is changed to the second state by being pressed by the liquid Q which has flown into (i.e., has been introduced into) the space 12. As a result, the volume of the space 12 is increased, whereby an excessive increase of the inner pressure of the space 12 caused by pushing the plunger is suppressed. Thus, the pressure control can be omitted even though it had been necessary to control the pressure inside the prior vial container containing the powdery medicine necessary to be dissolved by sucking the air into the syringe from the vial container by the amount of the dissolving liquid to be injected Air is released from the vial container by the amount of the dissolving liquid to be injected so as to make the pressure inside the vial container negative. The above embodiment eliminates the need to release air as described above.

Additionally, the protection cover 6 in the proximal end side mounting state can reliably protect the bag body 4 in the second state.

Thereafter, the medicine P is completely dissolved in the liquid Q by shaking, and the medicinal liquid R is generated. In this instance, the liquid Q enters between the reversing part 42 and the medicine P as described above, and a contact area between the liquid Q and the medicine P is enlarged, whereby the liquid Q and the medicine P can be sufficiently and reliably mixed. As a result, the shaking time can be shortened.

Next, the medical container 1 is turned upside down, maintaining the connected state and then, the plunger of the syringe 20 is pulled to collect the medicinal liquid R into the syringe 20. In this instance, the reversing part 42 of the bag body 4 is pulled together with the medicinal liquid R, and changed to the first state. At this point, the space-side surface 421 is separated from the inner peripheral portion 2*a* as described above. Therefore, the medicinal liquid R can easily and reliably flow down to the mouth section 21 of the container body 2, passing between the space-side surface 421 of the reversing part 42 and the inner peripheral portion 2*a* of the container body 2. As a result, the medicinal liquid R can be easily and reliably collected. Also, since the reversing part 42 returns to the first state, it is possible to prevent the pressure inside the container body 2 (space 12) from being negative during the sucking operation. Thus, the pressure control can be omitted although it had been necessary to control the pressure inside the prior vial container containing the powdery medicine necessary to be dissolved by returning the air from the syringe to the vial container by the amount of the medicinal liquid sucked into the syringe.

Additionally, there is a possibility that the medicine leaks from the needle hole. The reason for this leakage of the medicine is that, when the pressure inside the vial container is negative, force is applied from the syringe to the medicine inside the vial container. As described, the medicine in the tip and inside of the needle may be leaked by negative forced pressure. The medical container described here avoids the above disadvantage.

In the case where the medicine R is preliminarily contained inside the container body 2, the reversing part 42 is reversed to the proximal end side (second state) from the first state by the volume of the medicine R filled in the unused state. Accordingly, when the medicinal liquid R is collected to the syringe 20, the reversing part 42 is changed to the first state.

Therefore, it is possible to prevent the pressure inside the container body 2 (space 12) from being negative at the time of sucking. Also, it is possible to omit the pressure control in which the air is returned to the vial container from the syringe by the amount of the medicinal liquid sucked into the syringe.

Now, another embodiment of the medical container will be described below with reference to the drawings. The following description will be made to center on differences from the above-mentioned embodiment, and descriptions of the same items as above will be omitted.

The present embodiment is same as the first embodiment, except that mounting of a protection cover on a container body is different.

In the medical container 1 shown in FIGS. 7 to 11, a protection cover 6A is mounted by engagement with a container body 2A in both a distal end side mounting state and a proximal end side mounting state. Using the "engagement" to mount the protection cover 6A on a container body 2A, the protection cover 6A can be easily mounted on and detached from the container body 2A by simple pulling or pushing operation.

In the protection cover 6A, a female screw 622 is omitted from an inner peripheral portion 621 of a wall section 62, different from the protection cover 6 according to the first embodiment.

On the other hand, in the container body 2A, a distal-end outer peripheral portion 281 (male screw 282) is omitted from a ring portion 27, different from the container body 2 according to the first embodiment. Also, a male screw 263 and grooves 264 are omitted from a proximal-end outer peripheral portion 262 in the container body 2A.

Figure 7:
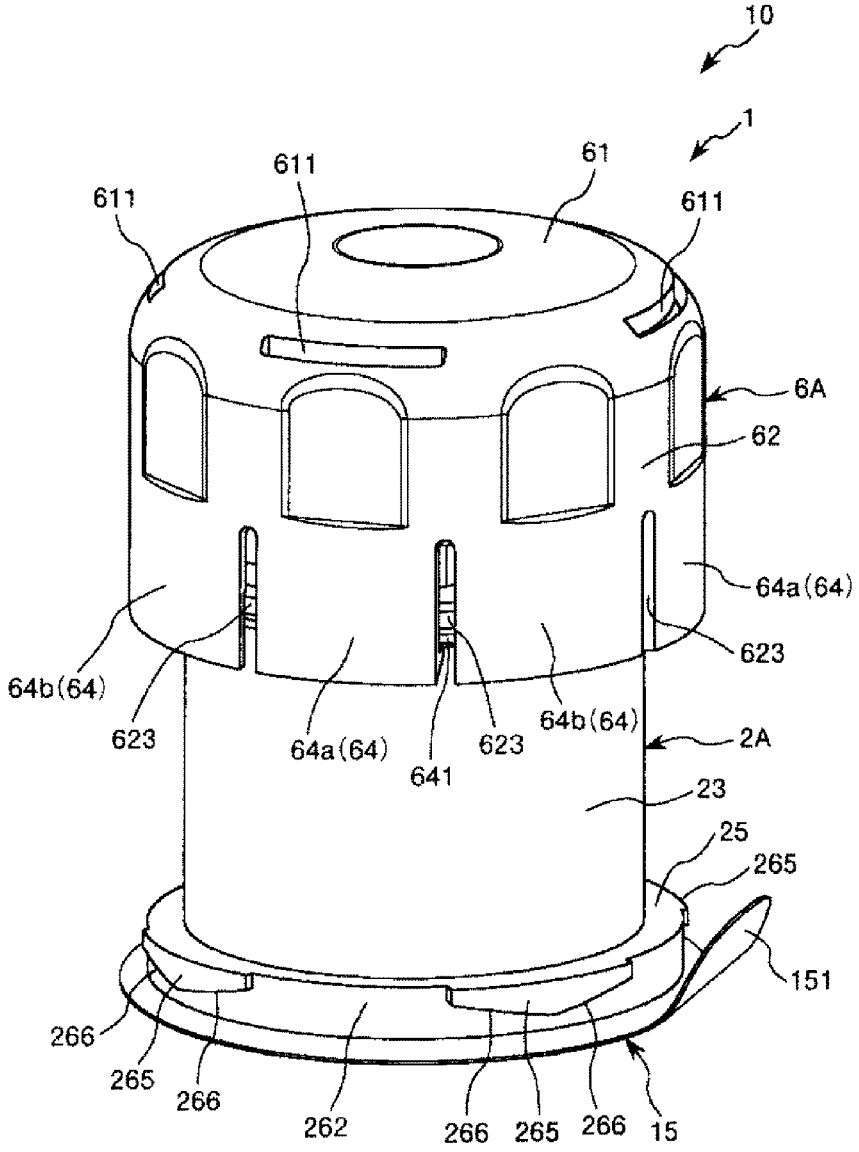
FIG. 7 is a perspective view showing a medical container in an unused state.

As shown in FIG. 7, a plurality of slits 623 (eight slits according to the present embodiment) are located on the wall section 62 of the protection cover 6A, extending from an opening 63 to a plate-shaped portion 61 and penetrating the wall section 62 in the thickness direction of the wall section 62. These slits 623 are arranged at intervals of equal angle around the axis of the wall section 62.

A plurality of plate pieces 64 (eight pieces according to the present embodiment) are located on the wall section 62 of the protection cover 6A by these slits 623. The neighboring plate pieces 64 are spaced, interposing the slit 623 therebetween.

Figure 8:
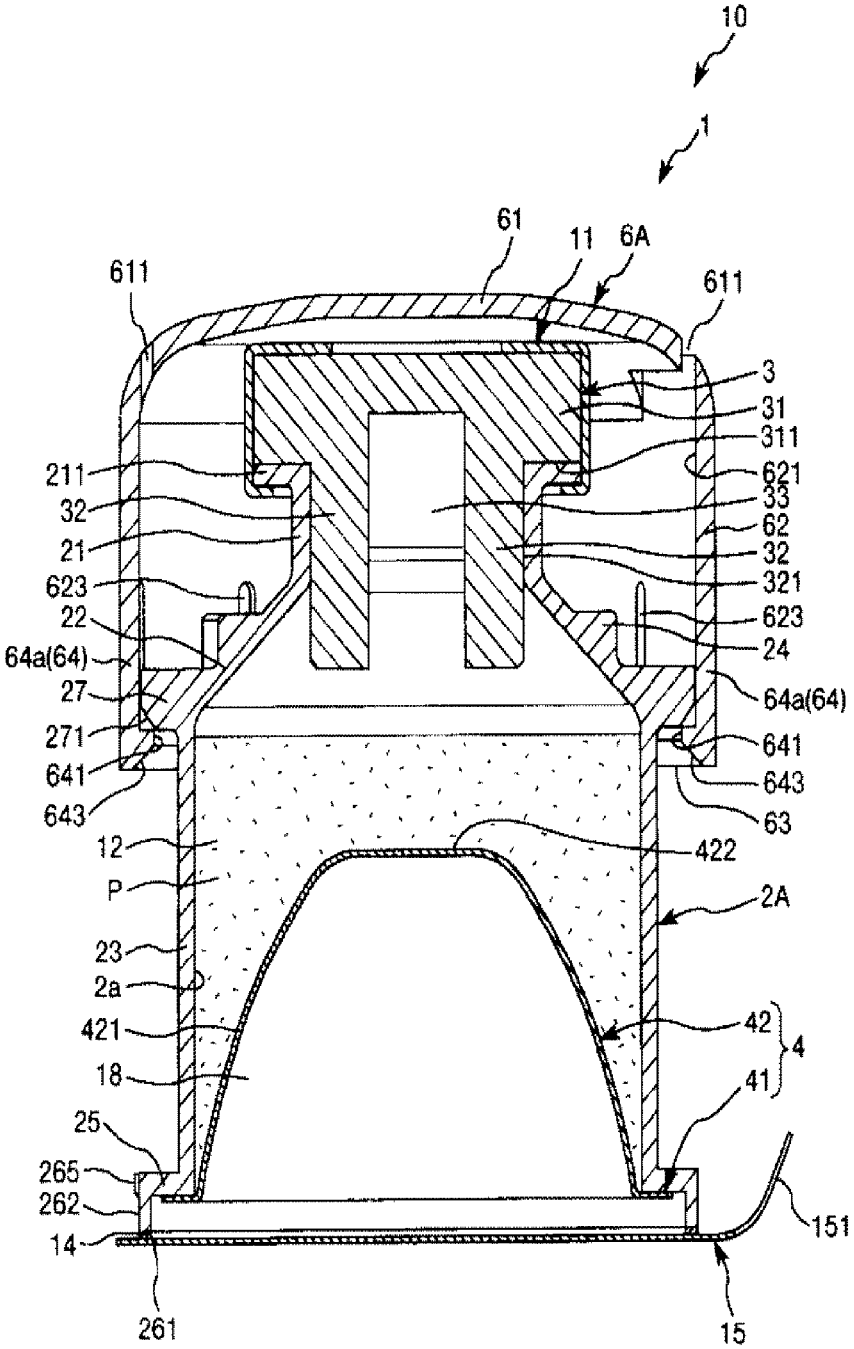
FIG. 8 is a longitudinal sectional view of the medical container shown in FIG. 7.
Figure 9:
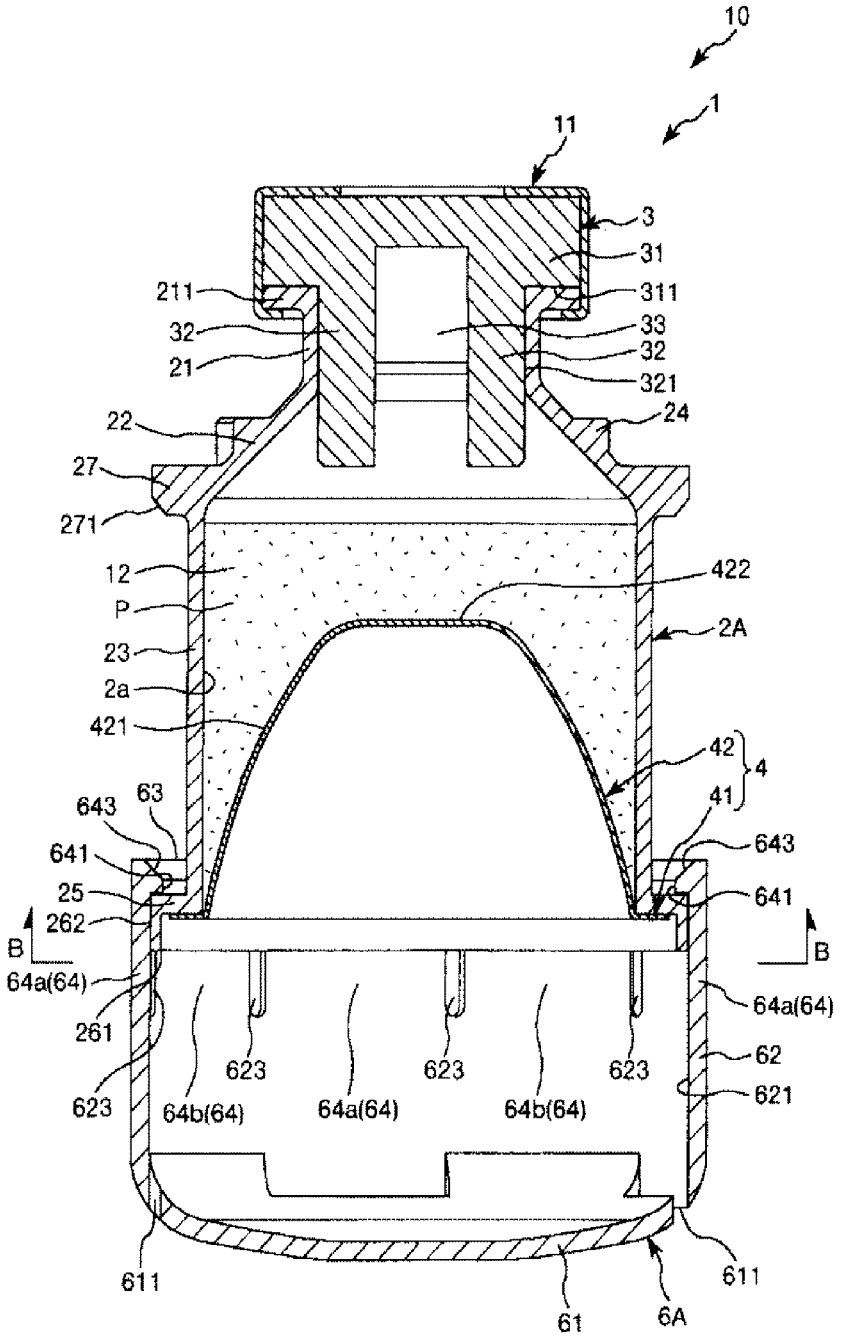
FIG. 9 is a longitudinal sectional view showing a medical container during operation.

As shown in FIGS. 8 and 9, an engagement section 641 projects inwardly at an edge portion on the side of the opening 63 in each of four plate pieces 64 out of eight plate pieces 64. Hereinafter, the plate piece 64 on which the engagement section 641 is formed will be referred to as "plate piece 64*a*".

Figure 10:
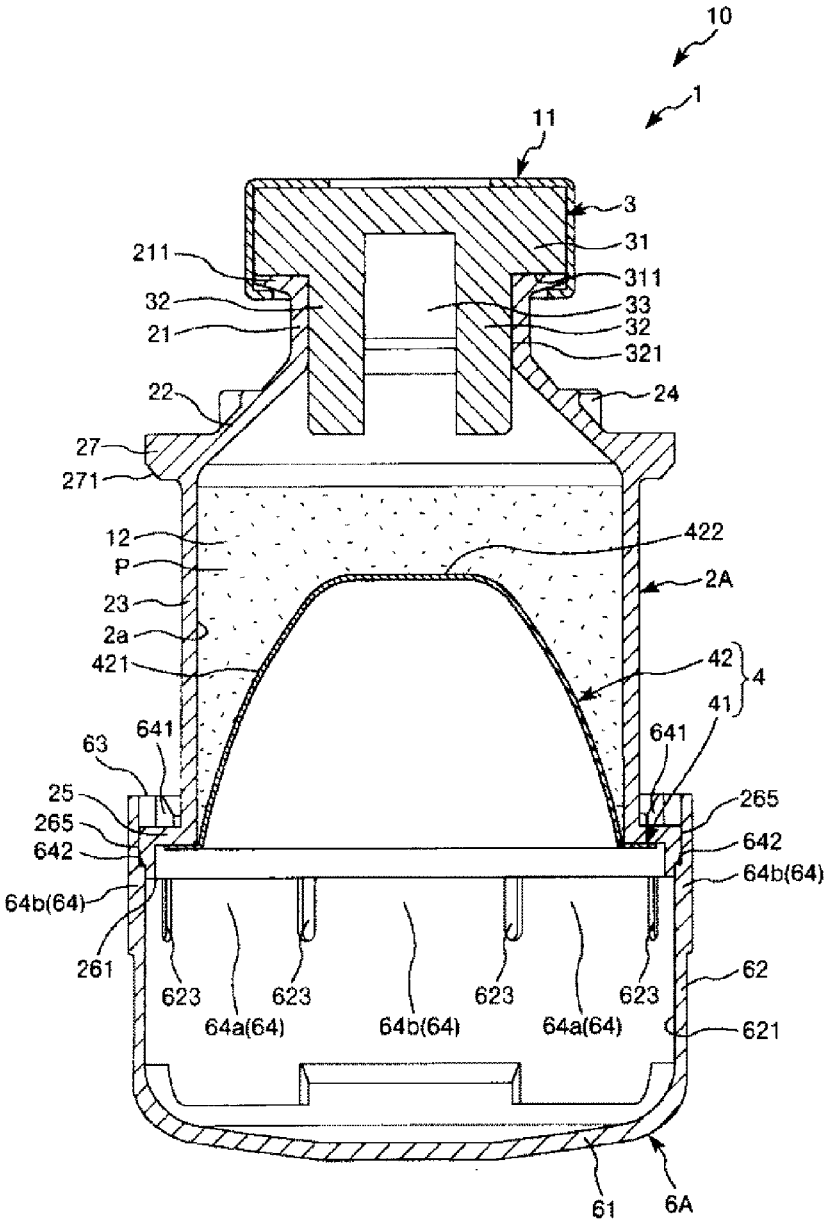
FIG. 10 is a longitudinal sectional view showing the medical container during operation.

As shown in FIG. 10, in each of remaining four plate pieces 64 out of the eight plate pieces 64 excluding the plate pieces 64*a*, a stepped section (restricting section) 642, in which the inside diameter is changed in a phased manner (rapidly), is at a location halfway of the axial direction of the wall section 62. Hereinafter, the plate piece 64 on which the stepped section 642 is formed will be referred to as "plate piece 64*b*".

Further, the plate pieces 64*a* and the plate pieces 64*b* are disposed alternately around the axis of the wall section 62.

As shown in FIG. 7, the container body 2A includes a plurality of projected sections 265 (four projected sections according to the present embodiment) which project on an outer peripheral surface of the proximal-end outer peripheral portion 262. These projected sections 265 are arranged at equal intervals along the circumferential direction of the proximal-end outer peripheral portion 262. Additionally, two slant surfaces 266, each of which is mutually slanted in an opposing direction, are formed at the proximal end of each projected section 265.

Further, in the distal end side mounting state shown in FIG. 8, an engagement section 641 of each plate piece 64*a* of the protection cover 6A is engaged with the ring portion 27 of the container body 2A. With this engagement, the protection cover 6A is restricted from unexpectedly moving upward, thereby reliably keeping the distal end side mounting state. Also, in the distal end side mounting state, the stepped section 642 restricts the protection cover 6A from moving downward and prevents the plate-shaped portion 61 from contacting the body cap 11.

A chamfer section 271 is formed at a lower corner section of the ring portion 27 of the container body 2A by chamfering. This makes it possible to easily detach the protection cover 6A from the container body 2A because, when the protection cover 6A in the distal end side mounting state is pulled upward, each of the plate pieces 64*a* expands outward while the engagement section 641 is climbing over the ring portion 27.

Also, in the proximal end side mounting state as shown in FIG. 9, the engagement section 641 of each plate piece 64*a* of the protection cover 6A is engaged with the proximal-end edge portion 25 of the container body 2A. This restricts the protection cover 6A from unexpectedly moving downward. Also, the projected section 265 of the container body 2A is engaged with the stepped section 642 of each plate piece 64*b* along with this engagement. This restricts the protection cover GA from unexpectedly moving upward. Thus, the proximal end side mounting state can be reliably maintained by restricting the protection cover GA from moving upward and downward.

Further, the protection cover 6A includes a slant surface 643 formed on the side of the opening 63 of the engagement section 641 of each plate piece 64*a*. With this configuration, at the time of changing the mounting state of the protection cover 6A to the proximal end side mounting state, the slant surface 643 can climb over the proximal-end outer peripheral portion 262 of the container body 2A, and therefore, the mounting operation can be easily and reliably carried out. Meanwhile, at the time of changing the mounting state of the protection cover 6A to the distal end side mounting state, the slant surface 643 can climb over the ring portion 27 of the container body 2A, and therefore, the mounting operation can be easily and reliably carried out.

Figure 11:
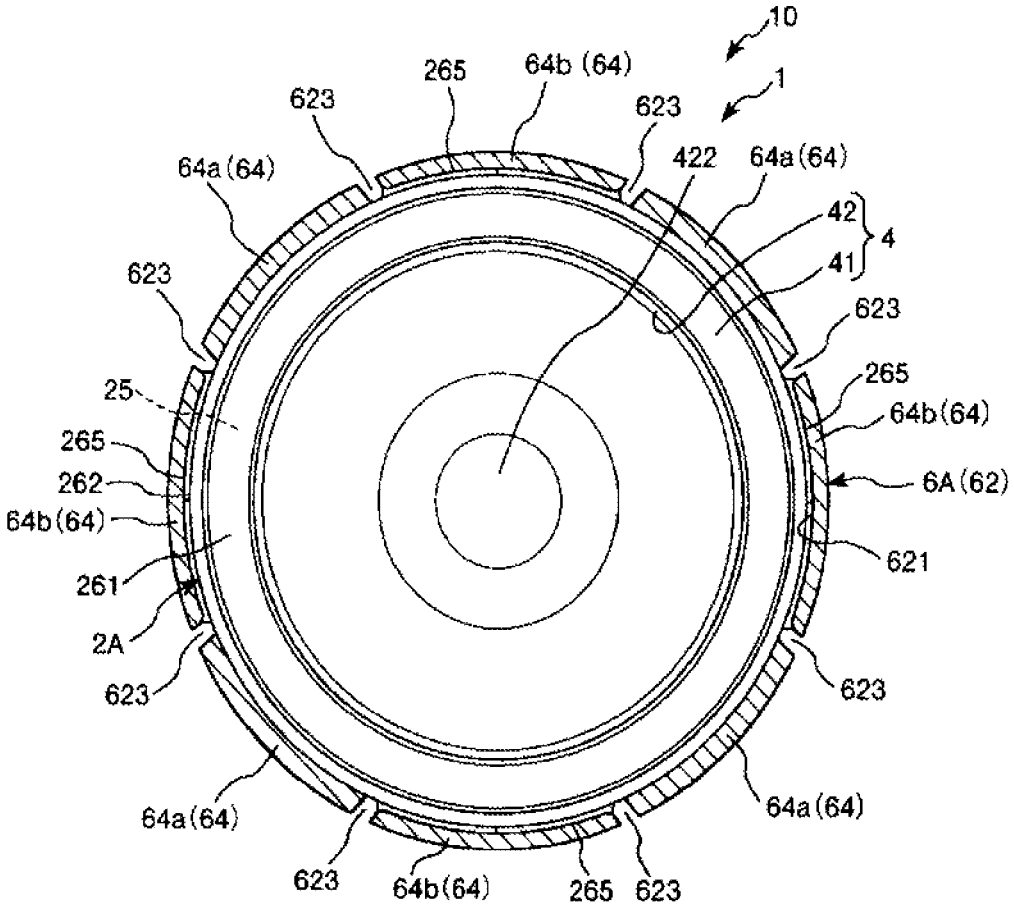
FIG. 11 is a cross-sectional view taken along a line B-B in FIG. 9.

Further, a circumferential side surface of each projected section 265 abuts a circumferential side surface of the plate piece 64*a* of the protection cover 6A in the proximal end side mounting state, whereby the container body 2A is reliably prevented from rotating about the axial direction of the container body 2A with respect to the protection cover 6A (see FIG. 11). By thus restricting the rotation, the container body 2A does not rotate with respect to the protection cover 6A when the syringe 20 is screw-engaged with the connector 30 mounted on the container body 2A while holding the protection cover 6A. As a result, the connection work can be easily carried out.

In the proximal end side mounting state shown in FIGS. 9 and 10, air can enter and exit the protection cover 6A through the respective slits 623 (communicating parts) of the protection cover 6A. With this configuration, the air between a bag body 4 and the protection cover 6A is pushed out when a reversing part 42 of the bag body 4 is changed to a second state from a first state, and vice versa, the air is sucked to between the bag body 4 and the protection cover 6A. As a result, the reversing part 42 can be easily and reliably reversed. Additionally, when the protection cover 6A is molded, the inside and outside of the protection cover 6A communicate with each other and the air can enter and exit the protection cover 6A through a plurality of through-holes (communication parts) 611. The through-holes penetrate the plate-shaped portion 61 in the thickness direction such that a molding component related to molding the engagement section 641 can be removed from these through-holes. With this configuration, the reversing part 42 can be more easily and reliably reversed.

According to one aspect, the stepped section 642 is formed on the protection cover 6A as a restricting section to restrict the protection cover 6A in the proximal end side mounting state from unexpectedly moving upward. However, the disclosure is not restricted as such, and any portion functioning as such a restricting section may be formed in the container body 2A.

While the medical container shown in the attached drawings has been described above, the present invention is not restricted to these embodiments, and each of the components of the medical container can be replaced with a constituent element that can exhibit an equivalent function. Further, constituent elements may be added.

In addition, the medical container may be one that is obtained by combining two or more constituent elements (characteristic features) of the above-described embodiments.

The medical container in an embodiment includes: a container body formed of a tubular body including a distal end opening opened at a distal end, a proximal end opening opened at a proximal end, and a proximal-end edge portion that surrounds the proximal end opening; a plug body that seals the distal end opening, a bag body having a bag-like shape and including an edge portion which is fixed in a fluid-tight manner to the proximal-end edge portion and seals the proximal end opening, and a reversing part which is surrounded by the edge portion, has flexibility and is reversed inside and outside; and a space surrounded by the container body, the plug body, and the bag body. When the liquid enters and exits the space through the distal end opening, the reversing part is reversed inside and outside, whereby the reversing part may take a first state and a second state. In the first state, the reversing part expands toward a distal end side, and in the second state, the reversing part expands toward a proximal end side. The medical container further includes a tubular protection cover which can take a proximal end side mounting state and a distal end side mounting state. In the proximal end side mounting state, the protection cover is mounted on the container body so as to cover the proximal end opening, and in the distal end side mounting state, the protection cover is mounted on the container body so as to cover the distal end opening. In the proximal end side mounting state, the protection cover can cover the bag body in the second state.

Therefore, when the medical container is in the unused state, the protection cover can take the proximal end side mounting state when the bag body has to be covered later during a period from start to end of use. As a result, in the medical container, it is possible to omit a component that covers the bag body when unnecessary to cover the bag body, and the medical container becomes advantageous to miniaturization by the volume of the component omitted.

The detailed description above describes a medical container disclosed by way of example. The invention is not limited, however, to the precise embodiment and variations described. Various changes, modifications and equivalents can effected by one skilled in the art without departing from the spirit and scope of the invention as defined in the accompanying claims. It is expressly intended that all such changes, modifications and equivalents which fall within the scope of the claims are embraced by the claims.

What is claimed is:

1. A medical container comprising:

a container body that is a tubular body; the container body including a distal end opening opened at a distal end, a proximal end opening opened at a proximal end, and a proximal-end edge portion which surrounds the proximal end opening, wherein a liquid can flow through the distal end opening;

a plug body contacting the distal end opening to form a liquid-tight seal;

a bag body including an edge portion fixed to the proximal-end edge portion in a fluid-tight connection, the bag body sealing the proximal end opening, and the bag body including a reversing part surrounded by the edge portion, the reversing part being flexible and being reversible inside/outside;

a space surrounded by the container body, the plug body, and the bag body;

the reversing part being reversed inside/outside when the liquid enters and exits the through the distal end opening by which the reversing part is positionable in a first state in which the reversing part expands towards a distal end side and a second state in which the reversing part expands toward a proximal end side; and a tubular protection cover positionable in a proximal end side mounting state in which the protection cover is mounted on the container body and covers the proximal end opening, and a distal end side mounting state in which the protection cover is mounted on the container body and covers the distal end opening, and in the proximal end side mounting state, the protection cover covers the bag body in the second state.

2. The medical container according to claim 1, wherein in the distal end side mounting state, the protection cover covers the distal end opening in an unused state of the medical container.

3. The medical container according to claim 2, wherein the protection cover is screw-engaged with the container body in both the proximal end side mounting state and the distal end side mounting state.

4. The medical container according to claim 3, wherein a screwing amount to screw-engage the protection cover in the proximal end side mounting state is larger than a screwing amount to screw-engage the protection cover in the distal end side mounting state.

5. The medical container according to claim 2, wherein the protection cover is engaged with the container body in both the proximal end side mounting state and the distal end side mounting state.

6. The medical container according to claim 5, further comprising:

a distal end side flange located at a distal end side of an outer peripheral portion of the container body;

a proximal end side flange located at a proximal end side of the outer peripheral portion of the container body;

each of the flanges projecting in a ring shape in a circumferential direction of the outer peripheral portion, the protection cover including a plate-shaped portion, and a wall section erected from an edge portion of the plate-shaped portion, the wall section having a cylindrical shape, and an engagement section located on an inner peripheral portion of the wall section, the engagement section being engaged with the proximal end side flange in the proximal end side mounting state, and engaged with the distal end side flange in the distal end side mounting state.

7. The medical container according to claim 6, wherein the wall section includes a plurality of plate pieces arranged around an axis of the wall section, the plurality of plate pieces being separated from one another, and the engagement section is formed on at least one plate piece out of the plurality of plate pieces.

8. The medical container according to claim 5, wherein at least one of the container body and the protection cover includes a restricting section to restrict the protection cover in the proximal end side mounting state from moving in the distal end direction.

9. The medical container according to claim 2, wherein, in the distal end side mounting state, a removable gas barrier sheet is joined to the proximal end opening, the gas barrier sheet seals the proximal end opening, and the gas barrier sheet prevents the transmission of oxygen and/or water vapor.

10. The medical container according to claim 1, wherein at least one of the container body and the protection cover includes a communication part such that an inside and outside of the protection cover communicate with each other in the proximal end side mounting state.

11. The medical container according to claim 1, wherein the bag body is separated from an inner peripheral portion of the container body in both the first state and the second state.

12. The medical container according to claim 1, wherein a syringe filled with the liquid is connectable to the distal end opening via a connector in the proximal end side mounting state, and the container body includes a rotation preventing means which prevents the connector from rotating about the axis of the distal end opening when the connector is connected to the distal end opening.

13. The medical container according to claim 1, wherein the space is preliminarily filled with a medicine.

14. A medical container comprising:

a tubular container body that includes a distal end opening open at a distal end of the container body, a proximal end opening open at a proximal end of the container body, and a proximal-end edge portion surrounding the proximal end opening, wherein a liquid can flow through the distal end opening;

a plug body sealing the distal end opening in a liquid-tight manner;

a bag body including an edge portion fixed to the proximal-end edge portion in a fluid-tight connection, the bag body sealing the proximal end opening of the container body, and the bag body including a reversing part surrounded by the edge portion, the reversing part being flexible and configured to switch from a first state to a second state;

wherein the reversing part expands towards the distal end in the first state and expands towards the proximal end in the second state;

a space being surrounded by the container body, the plug body, and the bag body;

a tubular protection cover, the tubular protection cover being mountable on the container body in both a proximal end side mounting state in which the protection cover is mounted on the container body and covers the proximal end opening, and a distal end side mounting state in which the protection cover is mounted on the container body and covers the distal end opening, and in the proximal end side mounting state, the protection cover covers the bag body in the second state; and the reversing part is in the first state when the liquid flows into the space, and the reversing part is in the second state when the liquid flows away from the space.

15. The medical container according to claim 14, further comprising a removable gas barrier sheet joined to the proximal end opening to seal the proximal end opening and prevent the transmission of oxygen and/or water vapor.

16. A method of extracting medicine from a medical container, the medical container comprising: a container body possessing a distal end opening opened at a distal end, a proximal end opening opened at a proximal end, and a proximal-end edge portion surrounding the proximal end opening; a plug body sealing the distal end opening; a bag body including an edge portion fixed to the proximal-end edge portion in a fluid-tight connection, the bag body sealing the proximal end opening, and the bag body including a flexible reversing part surrounded by the edge portion, and a space surrounded by the container body, the plug body, and the bag body, and a medicine stored in the space, the method comprising:

mounting a cover on the proximal end of the container body so that the cover covers the proximal end opening of the container body, the cover being mounted on the container body while the reversing part is in a first state in which an apex portion of the reversing part is positioned entirely in the cylinder body and an apex of the reversing portion is closer to the distal end of the container body than the proximal end of the container body;

adding a liquid to the space in which the medicine is stored by inserting a syringe through the plug body, the adding of the liquid to the space switching the reversing part from the first state to a second state in which the apex portion of the reversing part is positioned entirely in the cover and the apex of the reversing part is closer to the proximal end of the container body than the distal end of the container body;

mixing the medicine stored in the space with the liquid introduced into the space from the syringe to obtain a mixed liquid; and removing the mixed liquid from the space.

17. The method according to claim 16, wherein the reversing part switches from the second state to the first state when the mixed liquid is removed from the space.

18. The method according to claim 16, wherein the medicine directly contacts the reversing part before the liquid is added to the space, and the apex of the reversing part is a flat apex.

19. The method according to claim 16, wherein the tubular protection cover is mounted on the distal end of the container body before the tubular protection cover is mounted on the proximal end of the container body, the method further comprising removing the tubular protection cover from the distal end mounting state followed by the mounting of the tubular protection cover on the proximal end of the container body.

20. The method according to claim 16, further comprising connecting a connector to the distal end opening and connecting the syringe to the connector, followed by adding the liquid to the space.

* * * * *